United States Patent [19]

Suen et al.

[11] Patent Number: 4,651,761

[45] Date of Patent: Mar. 24, 1987

[54] ELECTRIC HIGH COMB-CLIPPER

[76] Inventors: Ru H. Suen, 388, Din San St., Kaohsiung, Taiwan, 80762; Wen B. Hsu, 24, Lane 108, Fon Nan Rd., Kaohsiung, Taiwan, 81122

[21] Appl. No.: 795,323

[22] Filed: Nov. 6, 1985

[30] Foreign Application Priority Data

Oct. 17, 1985 [TW] Taiwan ..... 74208663

[51] Int. Cl.[4] ..... A45D 24/00

[52] U.S. Cl. ..... 132/148; 30/210; 30/214

[58] Field of Search ..... 132/148; D28/52, 53, D28/54; 30/208, 209, 210, 213, 214, 223, 123

[56] References Cited

U.S. PATENT DOCUMENTS

| | | | |
|---|---|---|---|
| 123,180 | 10/1940 | Pileggi | D28/52 |
| 2,132,025 | 10/1938 | Gonsett | 132/148 |
| 2,702,940 | 3/1955 | Dickerson | 30/210 |
| 3,046,654 | 7/1962 | Letchfield et al. | 30/210 |
| 3,079,687 | 3/1963 | Jepson | 30/210 |
| 3,083,456 | 4/1963 | Marchant | 30/210 |
| 3,812,389 | 5/1974 | Bowerman | 30/210 |

*Primary Examiner*—Gene Mancene
*Assistant Examiner*—John G. Weiss
*Attorney, Agent, or Firm*—Holman & Stern

[57] ABSTRACT

This invention concerns about an electric hair comb-clipper. It mainly uses a magnetism generator which, by its two magnetic poles, changes the polar of the two poles when AC current is on, enabling the swing block with two poles to swing up and down forcing a movable clipper blade to move back and forth straight as well. Below the movable blade, a comb is attached to the base for combing hair; after hair has been combed by the comb, the base is turned around for 90 degrees to have hair cut off by the movable blade.

2 Claims, 5 Drawing Figures

ELECTRIC HIGH COMB-CLIPPER

BACKGROUND OF THE INVENTION

This invention, an electric hair comb-clipper, is made especially for professional use. Nowadays, when a barber works, he/she always has to hold at least two kinds of tools in his/her right hand, i.e. to comb the hair with a comb in his/her right hand first then to pinch hair with the index and middle fingers of the left hand, and next cut off the hair with a pair of scissors in the right hand. Such an action of alternate change in holding a comb or a pair of scissors can only be done smoothly by an well-experienced person. Moreover, when a variety of combs or scissors is needed, it actually makes up a kind of inconvience for a barber.

This invention has been worked out to provide a kind of tool for more convenient use in combing and cutting hair at the same time.

DETAILED DESCRIPTION OF THE INVENTION

Figure 1:
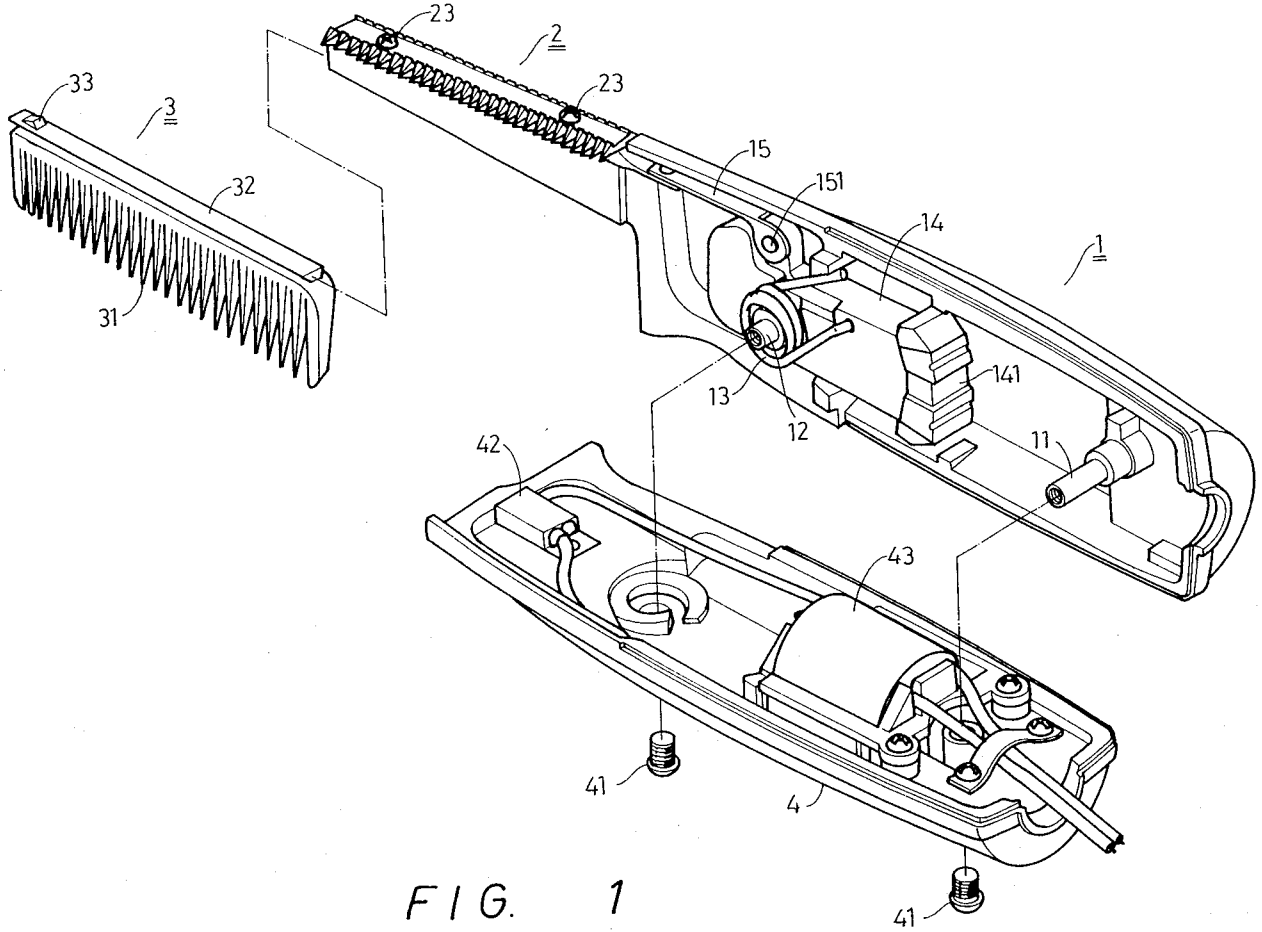
FIG. 1 is the stereo view of the electric hair comb-clipper in this invention.

As shown in the FIG. 1, this invention includes a base 1, clipper blades 2, a comb 3 and a cover 4.

Figure 2:
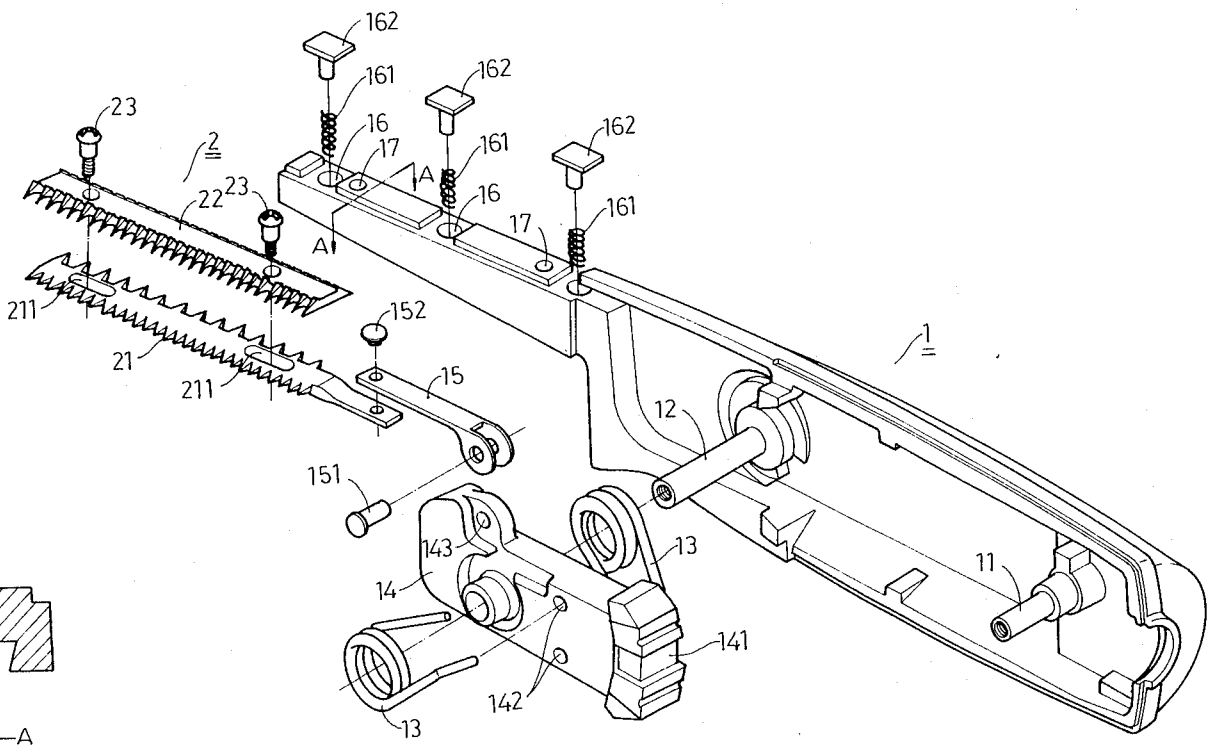
FIG. 2 is the analytical view of the base in this invention.
Figure 3:
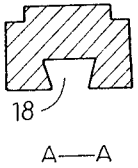
FIG. 3 is the cross-section view of A—A (the front of the base) in the FIG. 2.

The base 1 is a plastic shell which, as shown in the FIG. 2, is set up with two combining columns 11, 12 used to combine itself with the cover 4. The column 12 can combine with two springs 13 and a swing block 14 euqipped with a magnet 141 having different magnetic poles at its two sides; two holes 142 are provided for the springs 13 to stick one of their ends in. A pin hole 143 is bored to connect by a pin 151 with an arm 15 that is riveted with the movable clipper blade 21 of the clipper blades 2 with a rivet 152; the front part of the base 1 is to be combined with the clipper blades 2 by means of three holes 16 which springs 161 are inserted in with plates 162 sustained on; two screw holes 17 are bored to fix the clipper blades 2 on, and the underside of the front of the base 1 is cut with a dovetail groove, as shown in the FIG. 3, for the comb 3 to combine with.

The clipper blades 2 comprise a movable blade 21 and an immovable blade 22 of the same shape and teeth size and these two blades 21, 22 smoothly contact each other; the movable blade 21 is linked together with an arm 15 by a rivet 152 and is bored with two elliptic holes 211 for bolts 23 both to penetrate through and for the blade itself to move back and forth straight.

The immovable blade 22 is also bored with two holes 221 for the bolts 23 to penetrate through. The bolts 23 are used to combine together the immovable blade 22 with the movable blade 21, screwing in the screw holes 17 of the base 1. Through up-pushing of the movable blade 21 from underside by the plates 162 set on the base 1, the two blades can contact so closely that, due to the moving of the movable blade 21, they are able to cut off the hair coming into the teeth gaps.

Again, as shown in the FIG. 1, the comb 3 is set up with a dovetail-shaped rail 32 on its upper side which is able to run into the dovetail groove 18 of the base 1 so that a variety of combs is available. In addition, a stopper at the end of the rail 32 is used to confine the position of the comb 3.

The cover 4 is to be matched with and screwed on the base 1 by screwing bolts 41 into the columns 11, 12. Set inside the cover 4 is a power switch 42 and a magnetism generator 43; the switch 42 controls the electric power for the magnetism generator 43 that has two poles 431, 432 at its front which, once the switch 42 is turned on, will be made to generate a magnetism that changes the polar of its two poles because of AC current porducing sucking force against the two mannetic poles on the swing block 14 so that the swing block 14 is induced to swing to and fro quickly.

Figure 4:
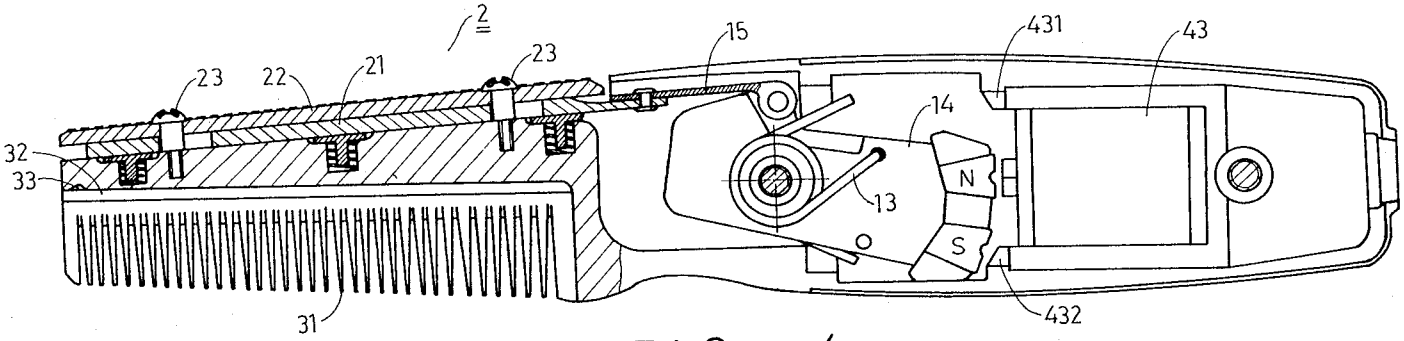
FIG. 4 is the view of one action of this hair comb-clipper in this invention.
Figure 5:
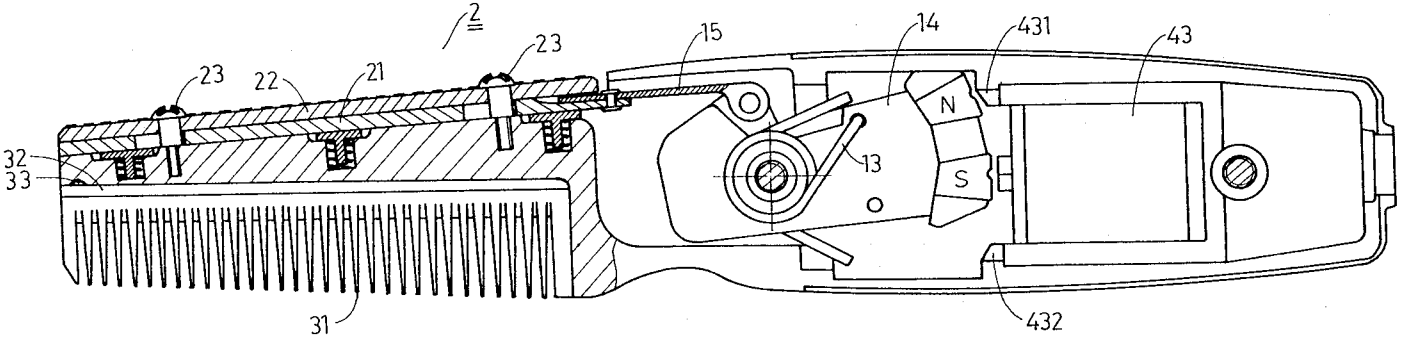
FIG. 5 is the view of another action of this hair comb-clipper in this invention.

As shown in the FIGS. 4, 5, after this comb-clipper has been assembled together according to the description mentioned above and the switch is turned on, the two poles 431, 432 of the magnetism generator 43 generate magnetism, which produces magnetic sucking force towards the magnet 141 on the swing block 14; then with the assistance of the retrieving force of the springs 13, the swing block 14 moves up and down so that the movable blade 21 is made to move back and forth by means of the connecting arm 15 that is moved by the swing block 14; in the result, the movement of the movable blade 21 is able to cut off the hair coming into the teeth gaps of the clipper blades 2.

The correct use of this comb-clipper is, at first to comb hair with the comb teeth 31 keeping the clipper blades 2 from touching hair; when the comb teeth come to the hair tip, the user truns the comb for 90 degrees enabling the clipper blades to contact with the hair and cut it off attaining the purpose of this invention.

What is claimed is:

1. A hair cutting tool comprising base means defining a handle and an elongate limb extending from one end of the handle, the limb having upper and lower edges which converge toward a distal end of the limb, the lower edge defining an elongate dovetail element, a comb having a spine with a complimentary dovetail element for receipt by the elongate dovetail element aforesaid, and comb prongs extending from the spine lengthwise thereof, a clipper blade assembly mounted on the upper edge of the limb comprising a fixed upper clipper blade and a reciprocatory lower clipper blade, the blades having cooperating clipper teeth located in a plane substantially perpendicular to a plane containing the prongs of the comb, the upper clipper blade being secured to the limb by screws extending through longitudinal slots in the lower clipper blade to allow lengthwise reciprocation of the lower blade, the limb including apertures with spring plungers therein, the plungers including flat plates received in corresponding recesses formed in the upper edge of the limb, the plates engaging the lower clipper blade and urging same into pressure contact with the upper clipper blade, and the handle including electric drive means for reciprocating the lower blade lengthwise in relation to the upper clipper blade and a connecting arm between the drive means and a proximal end of the lower clipper blade.

2. A tool as defined in claim 1 wherein the drive means comprises a magnetic swing block pivotally mounted in the handle, a pivot connection between the swing block and said arm, and a magnetic force generator and spring means associated with the swing block for pivotally reciprocating same in a manner effective for reciprocating the lower clipper blade lengthwise with respect to the upper clipper blade.

* * * * *